US007568812B1

(12) United States Patent
Kumthampinij et al.

(10) Patent No.: US 7,568,812 B1
(45) Date of Patent: Aug. 4, 2009

(54) PERSONAL HEADLAMP

(75) Inventors: Yos Kumthampinij, Edgewater, NJ (US); Kenneth Zorovich, Hoboken, NJ (US); John Earle, Annapolis, MD (US); Jesse DelGigante, Verona, NJ (US); Cleatis A. Eichelberger, Mount Laurel, NJ (US)

(73) Assignee: Princeton Tectonics, Inc., Bordentown, NJ (US)

( * ) Notice: Subject to any disclaimer, the term of this patent is extended or adjusted under 35 U.S.C. 154(b) by 24 days.

(21) Appl. No.: 12/034,126

(22) Filed: Feb. 20, 2008

(51) Int. Cl.
*F21V 21/084* (2006.01)

(52) U.S. Cl. ..... 362/105; 362/106; 362/197; 362/199; 362/287

(58) Field of Classification Search ..... 362/103, 362/105, 106, 108, 184, 190, 191, 197, 199, 362/285, 287, 418, 419, 427, 249.07, 249, 362/1, 249.09, 249.11, 249.12
See application file for complete search history.

(56) References Cited

U.S. PATENT DOCUMENTS

| | | | | |
|---|---|---|---|---|
| 6,578,994 | B1 * | 6/2003 | Beyerlein | 362/490 |
| 6,877,875 | B2 * | 4/2005 | Yu et al. | 362/105 |
| 6,932,487 | B2 * | 8/2005 | Aknine | 362/106 |
| 7,125,139 | B2 * | 10/2006 | Kumthampinij et al. | 362/200 |
| 2008/0205036 | A1 * | 8/2008 | Tarter et al. | 362/105 |

OTHER PUBLICATIONS

U.S. Appl. No. 29/303,904 by inventors Yos Kamthampinij, et al. filed Feb. 20, 2008.

* cited by examiner

*Primary Examiner*—Thomas M Sember
(74) *Attorney, Agent, or Firm*—Howson & Howson LLP

(57) ABSTRACT

In a personal headlamp, a housing, containing both an illumination source and a power source, is mounted in cantilever fashion on a bracket that comprises a back part and a collar fastened to, and extending forward from, the back part. A resilient pawl, which extends from the back part through a slot in the collar, is engageable with any selected one of a series of circumferentially spaced notches formed on a ring-like protrusion on the housing that fits rotatably into the collar.

10 Claims, 5 Drawing Sheets

PERSONAL HEADLAMP

FIELD OF THE INVENTION

This invention relates to headlamps, and particularly to a personal headlamp, worn by an individual to provide illumination for various activities, such as hiking, bicycling, cave exploration, etc.

SUMMARY OF THE INVENTION

A personal headlamp is typically a battery-powered lamp, mounted on an adjustable head strap so that it can be worn on the head, leaving the wearer's hands free. The source of illumination in the headlamp can be one or more incandescent bulbs or light-emitting diodes (LEDs) or a combination thereof. The headlamp typically comprises a housing containing the illumination source or sources, a switch for turning the lamp on and off, and a power source comprising one or more electrochemical cells ("batteries"). In some headlamps, especially those designed for heavy duty, the power source is a battery pack separate from the housing containing the illumination source. Electronic circuitry is frequently included for control of brightness and for selection of operating modes.

A desirable feature incorporated into some personal headlamps is a tilting capability by which the headlamp can be tilted up and down relative to a bracket by which it is attached to a head strap. The tilting capability enables the user to direct the beam straight ahead for normal use, and to tilt the beam downward in order to read a map, for example. A detent mechanism comprising a pawl and a set of cooperating teeth is usually provided as part of the tilting mechanism in order to hold the lamp firmly in a selected position.

In most tiltable headlamps, the detent mechanism is located between the bracket and the lamp housing, requiring the housing to be spaced forward of the bracket. In a headlamp in which the power source is contained in the same housing with the illumination source, the housing should be pivoted on a pivot axis near its center of gravity, or other measures should be taken to ensure that the detent mechanism is capable of supporting the housing in any of its several selectable positions. The combination of a detent mechanism and housing containing a power source can also result in a bulky structure. In addition, when the power source is contained in the same tiltable housing with the illumination source, battery replacement can be difficult.

SUMMARY OF THE INVENTION

This invention addresses some of the problems encountered in designing a compact tiltable headlamp in which the power source and illumination source or sources are contained in the same housing. Briefly, the housing containing both the illumination source and the power source is rotatably mounted in cantilever fashion on a bracket that comprises a back part and a collar fastened to, and extending forward from, the back part. A pawl is incorporated into the collar so that it is laterally displaced from the part of the housing that contains the power source. In this way, the distance between the back part of the mounting bracket and the part of the housing containing the power source can be minimized, the detent mechanism can be made sufficiently robust to support the housing reliably in any of its selectable positions, and a very compact housing structure can be realized.

More particularly, the headlamp according to the invention comprises a mounting bracket having a back part connectable to a headstrap, a front face, and a collar connected to the front face and extending perpendicularly forward from the front face. The collar has a substantially circular opening centered on an axis substantially parallel to the front face of the bracket. A headlamp unit supported by the bracket, comprises a housing having first and second ends, a compartment for receiving an electric power source, and a ring-shaped protrusion at the first end of the housing. The ring-shaped protrusion fits rotatably in the circular opening of the collar, so that the headlamp unit is rotatable about said axis. At least one light-emitting element is positioned between the first and second ends of the housing and arranged to project a beam of light in a direction perpendicular to said axis. A set of circumferentially spaced notches is formed on the ring-shaped protrusion adjacent the first end of the housing, and a resilient pawl fixed to the back part of the mounting bracket is engageable with the notches, and is in engagement with one of the notches for maintaining the headlamp unit in a fixed position within its range of rotation.

Preferably, the collar is the sole means by which the headlamp unit is supported from the back part of the mounting bracket.

In the preferred embodiment, a circumferential slot is provided in the collar, and the resilient pawl, which is preferably a unitary part of the back part of the mounting bracket extends from the front face of the back part of the mounting bracket, through the circumferential slot, and into the circular opening of the collar for engagement with the notches on the ring-shaped protrusion.

In the preferred embodiment, the collar is removably secured to the back part of the bracket, preferably by screw fasteners extending through the back part of the bracket and threaded into the collar.

In the preferred embodiment, an end cap, connected to the ring-shaped protrusion at the first end of the housing, bears against the collar and prevents the headlamp unit from disengaging from the collar, and at least two radially projecting tabs, formed on the ring-shaped protrusion, hold the end cap on the ring shaped protrusion.

The substantially circular opening of the collar preferably has a plurality of axial slots formed therein and positioned to provide clearance for the tabs on the ring-shaped protrusion when the ring-shaped protrusion is fitted into the opening of the collar during assembly of the headlamp.

Preferably, one of the notches on the ring-shaped protrusion extends to the first end of the housing, the other notches terminate short of the first end of the housing, and the notch that extends to the first end of the housing is positioned to register with the pawl when the tabs formed on the ring-shaped protrusion register with the axial slots in the collar. In this way pawl can be prevented from interfering with the assembly of the headlamp.

The personal headlamp according to the invention is compact, and yet easily tilted to a selected position within a range of positions in order to aim the headlight beam for maximum illumination in a desired direction. The detent mechanism is capable of holding the headlamp unit reliably at the desired angle, and the headlamp can nevertheless be easily grasped and adjusted especially because it is mounted in cantilever fashion on a collar located adjacent one end of the lamp housing. Battery installation and replacement is simple because access to the battery compartment is through a door located at the end of the housing remote from the collar.

Other details and advantages of the invention will be apparent from the following detailed description when read in conjunction with the drawings.

DETAILED DESCRIPTION OF THE PREFERRED EMBODIMENT

Figure 1:
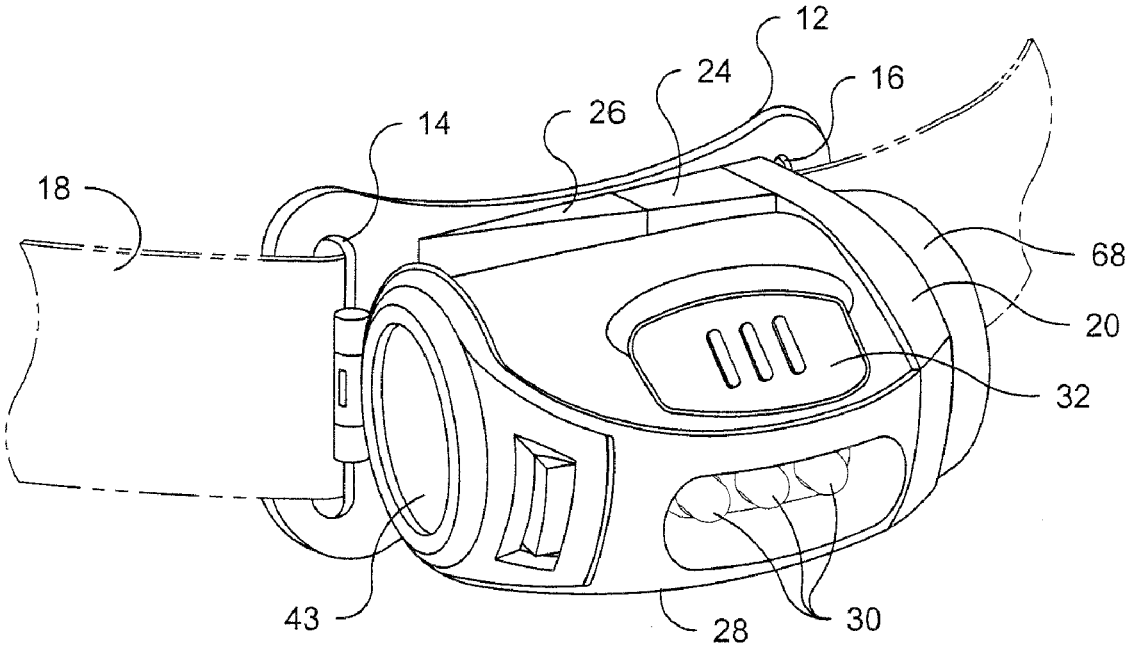
FIG. 1 is a perspective front elevational view of a personal headlamp according to the invention.
Figure 2:
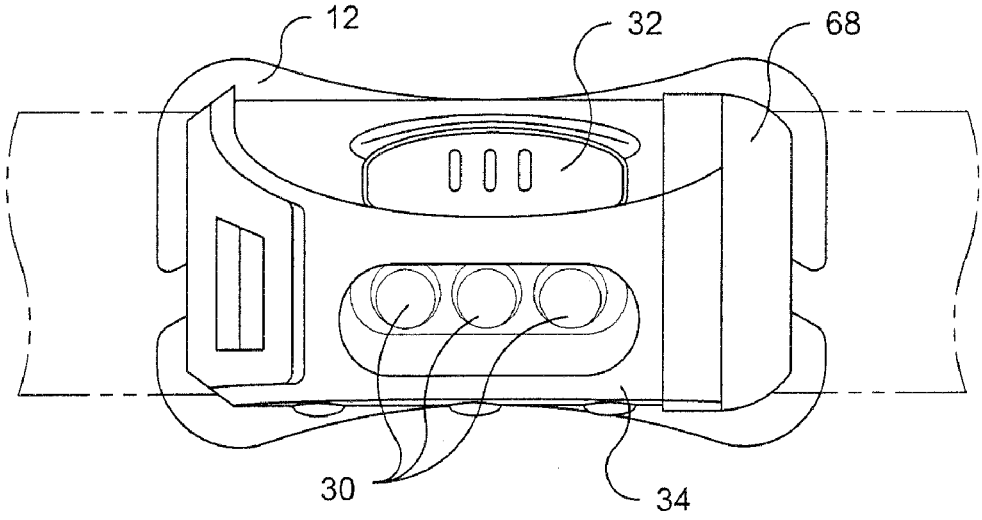
FIG. 2 is a front elevational view thereof.
Figure 3:
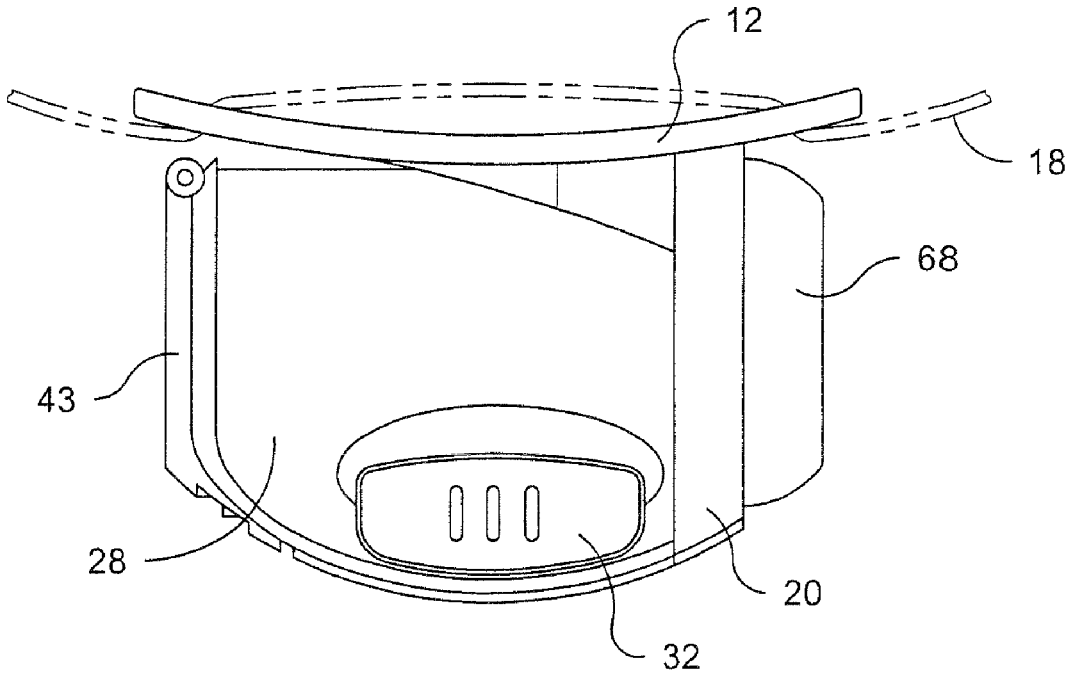
FIG. 3 is a top plan view thereof.
Figure 4:
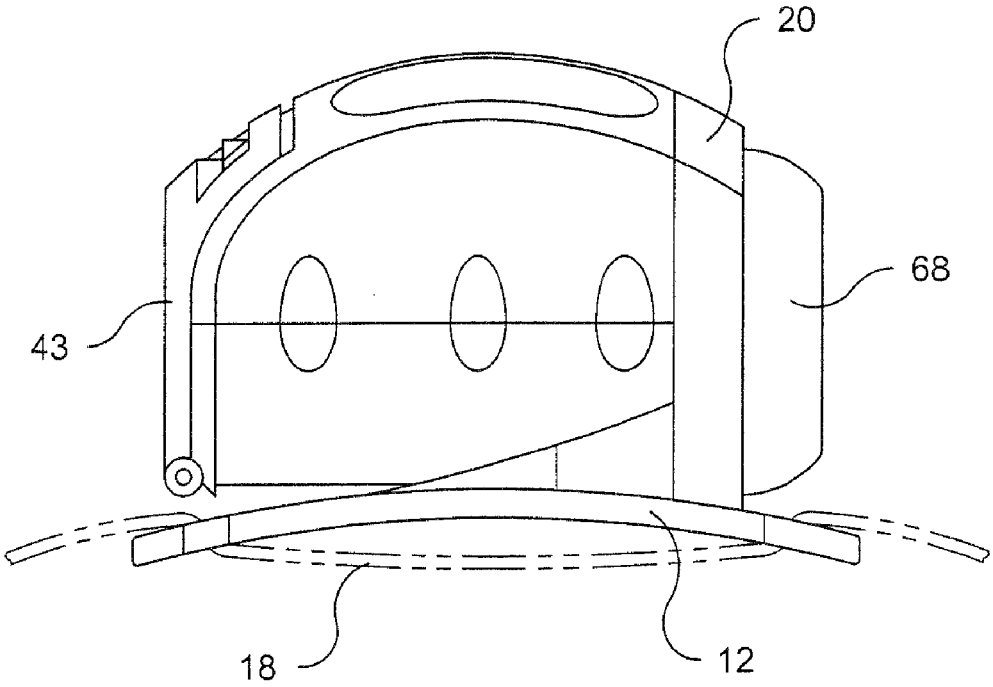
FIG. 4 is a bottom plan view thereof.
Figure 5:
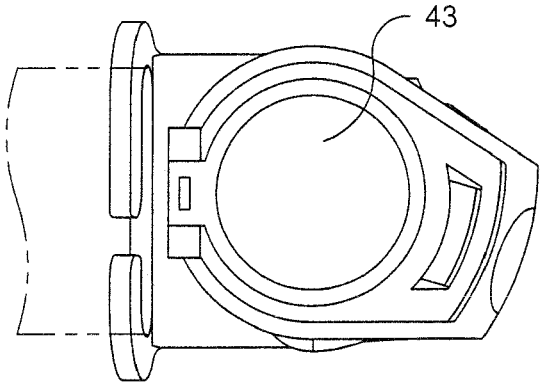
FIG. 5 is a left side elevational view thereof.
Figure 6:
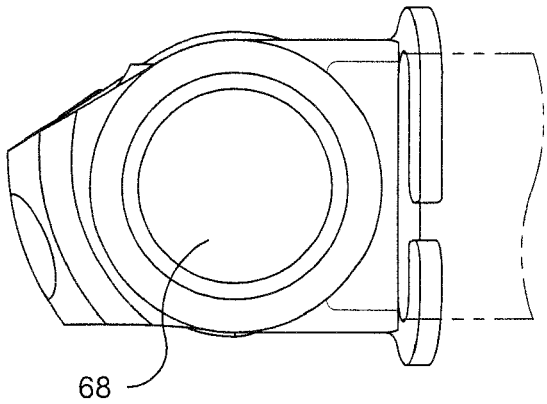
FIG. 6 is a right side elevational view thereof.
Figure 7:
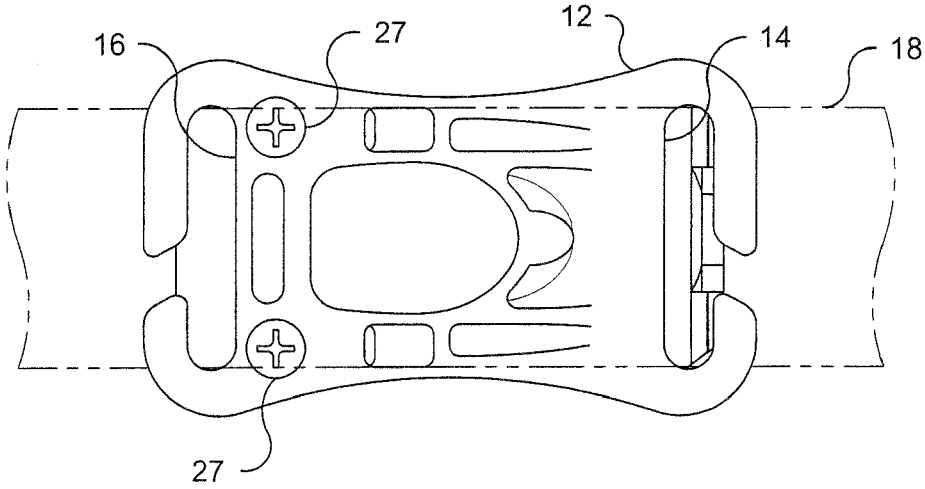
FIG. 7 is a rear elevational view thereof.
Figure 8:
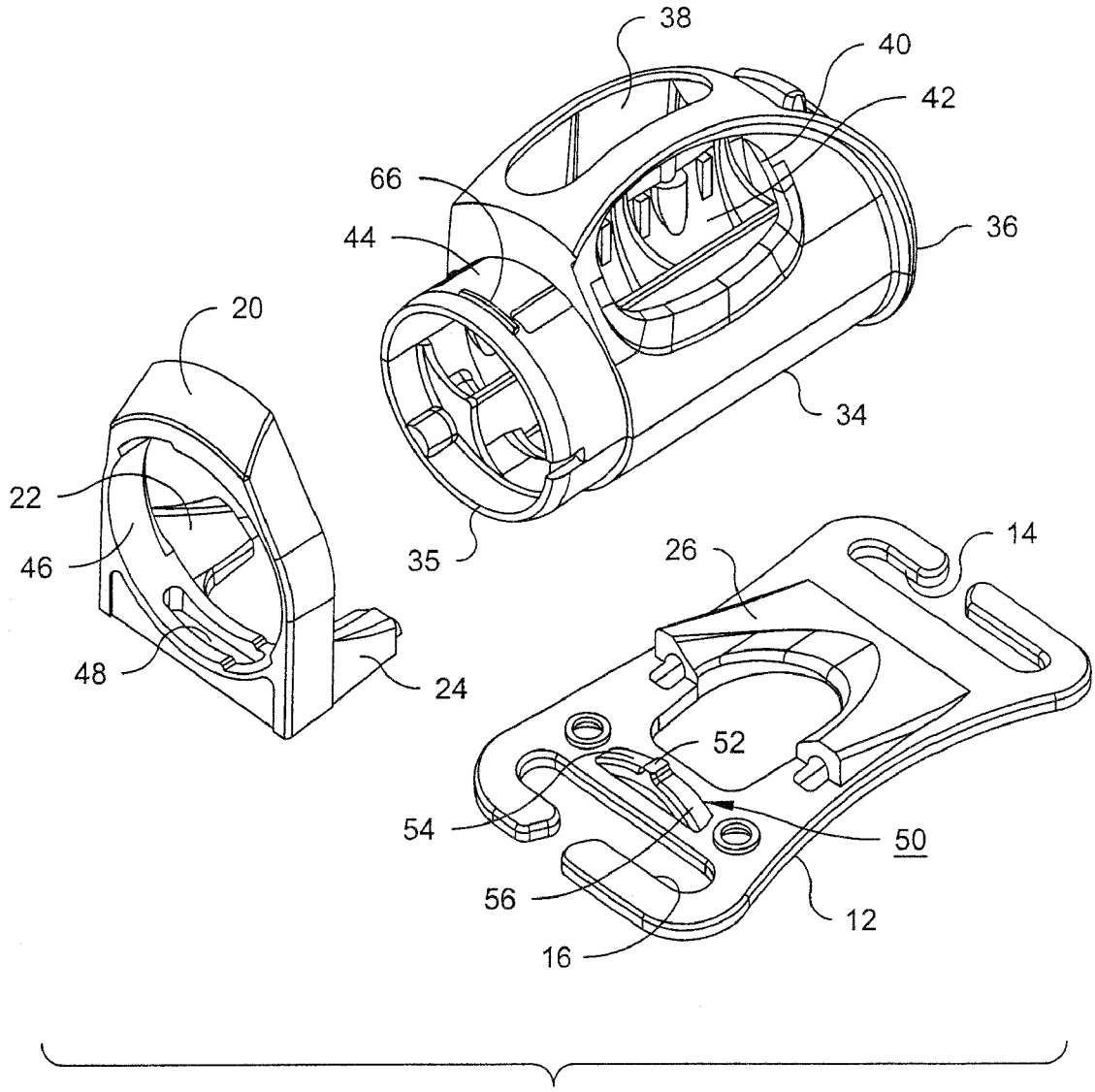
FIG. 8 is an exploded perspective view of the principal components of the personal headlamp according to the invention.

As shown in FIG. 1, the headlamp mounting bracket comprises a back part 12 in the form of a molded plate, slightly curved, as shown in FIGS. 3 and 4, so that it has a convex front face and a concave back face shaped to conform to the shape of the user's head. A head strap 18 extends through pair of slots 14 and 16 provided in the back part, as shown in FIGS. 3, 4 and 7. The mounting bracket also comprises a collar 20, which extends perpendicularly forward from the convex front face of the back part 12. The collar 20 has a pair of integrally molded feet 22 and 24, which meet a U-shaped reinforcement 26 formed on the front face of the back part, as shown in FIG. 8. The collar is secured to the back part 12 by a pair of screws 27, shown in FIG. 7.

The collar is positioned adjacent slot 16 near one end of the back part, and a headlamp unit 28, mounted in the collar, extends, in cantilever fashion, from the collar, across the front face of the back part, being supported from the back part solely by the collar.

The headlamp unit 28 includes light-emitting elements 30, preferably light-emitting diodes, arranged to project a beam of light forward. A push-button 32 is provided at the top of the headlamp unit for controlling the light-emitting elements. The push-button can be a simple on-off switch. Preferably, however, the push-button is associated with an electronic circuit (not shown) which enables the user not only to turn the light-emitting elements on and off, but also to select a brightness level from among two or more different brightness levels, and to select one or more flashing modes. Electronic devices suitable for this purpose are described in U.S. Pat. Nos. 6,249,089, 6,621,226, and 6,650,066, the disclosures of which are here incorporated by reference.

The headlamp unit comprises a housing 34, which, as shown in FIG. 8, has a first end 35 and a second end 36. An opening 38 in the housing accommodates the light-emitting elements, and an opening 40 accommodates the push-button. An internal compartment 42 is provided to receive an electric power source, which can be composed of one or more electrochemical cells (not shown). In the particular embodiment shown, the preferred power source consists of three AAA cells electrically connected in series. One end of the housing is closed by a door 43 (FIGS. 1, 3, 4 and 5), which can be opened for installation and removal of the AAA cells.

A ring-shaped protrusion 44 is formed at end 34 of the housing. This ring-shaped protrusion fits rotatably in a circular opening 46, formed in collar 20, as shown in FIG. 8. The circular opening 46 is centered on an axis that extends substantially parallel to the front face of the bracket. The axis is normally horizontal when the lamp is in use. The housing 34 is rotatable about this axis, at least through a limited range, and the beam projected by the light-emitting elements is directed perpendicular to the axis. Thus, the beam can be adjusted up and down by rotation of the housing 34 relative to collar 20.

As seen in FIG. 8, the collar 20 is formed with a circumferentially elongated slot 48, located in the part of the collar that meets the back part 12 of the mounting bracket. A pawl 50, formed on the back part 12 extends though the slot when the collar 20 is secured to the back part 12. The pawl is preferably molded as a unit with the back part 12, and comprises a projection 52 connected to the main body of the back part by resilient legs 54 and 56, which allow some radial movement of the projection 52 into and out of the opening 46 of the collar.

Figure 9:
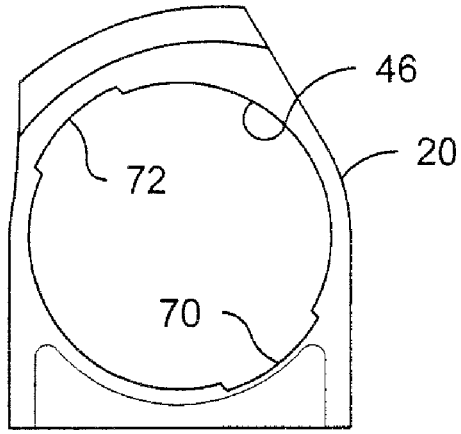
FIG. 9 is a side elevational view of the collar component of the bracket in FIG. 8.
Figure 10:
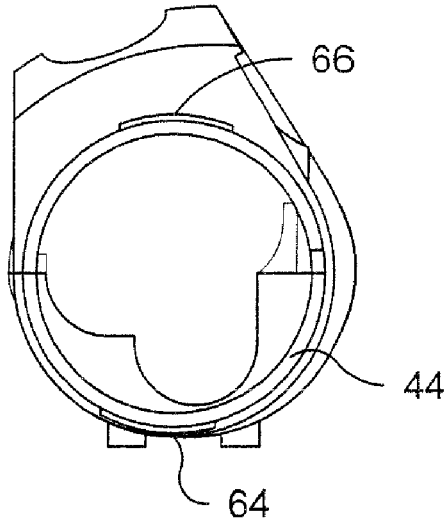
FIG. 10 is a side elevational view of the lamp housing in FIG. 8.
Figure 11:
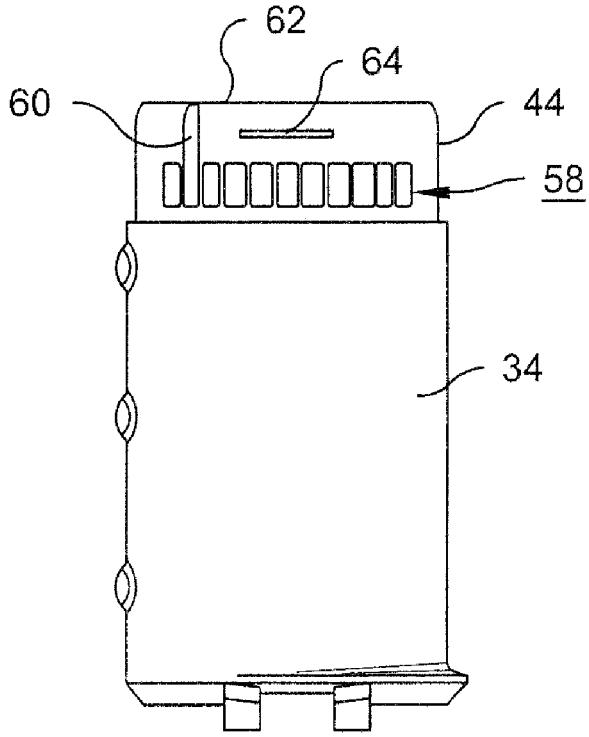
FIG. 11 is a bottom plan view of the lamp housing.

As shown in FIG. 11, a set 58 of circumferentially spaced notches is formed in the ring-shaped protrusion 44. These notches are positioned so that, when the protrusion 44 is fitted into the circular opening 46 in collar 20, any one of the notches can be engaged by projection 52, depending on the rotational position of the headlamp unit. One of the notches, notch 60, extends to the edge 62 of protrusion 44, allowing the protrusion 44 to be inserted into the collar when the notch 60 is aligned with projection 52. Two tabs, 64 and 66, are provided on the ring-shaped protrusion 44 as shown in FIG. 10. These tabs engage an end cap 68 (FIGS. 1-4 and 6), which is snapped onto the part of protrusion 44 that extends beyond the collar 20, after the protrusion 44 is inserted through the collar. When snapped into place, the end cap allows rotation of the housing relative to the collar, but prevents the housing from being removed from the collar. As shown in FIG. 9, recesses 70 and 72, which are formed in the opening 46 of the collar, and extend axially through the opening of the collar, are positioned to receive tabs 64 and 66, respectively, when the notch 60 is aligned with projection 52 during installation of the headlamp unit in the collar.

As mentioned previously, the personal headlamp according to the invention is compact, and easily tilted; its position is reliably maintained; and battery installation and replacement is simplified.

Various modifications can be made to the headlamp. For example, although the resilient pawl is preferably formed as a unit with the back part of the bracket, as an alternative, the pawl can be formed as a unitary part of the collar. Likewise although the end cap is used to secure the lamp housing to the collar, removal of the lamp housing from the collar can be prevented by any of various alternative means such as projections on the ring-like protrusion that engage the collar directly.

Still other modifications may be made to the apparatus and method described above without departing from the scope of the invention as defined in the following claims.

We claim:

1. A personal headlamp comprising:

a mounting bracket having a back part connectable to a headstrap, a front face, and a collar connected to the front face and extending perpendicularly forward from the front face of the back part of the bracket, the collar having a substantially circular opening centered on an axis substantially parallel to the front face of the bracket;

a headlamp unit comprising a housing having first and second ends, a compartment for receiving an electric power source, a ring-shaped protrusion at said first end of the housing, the ring-shaped protrusion fitting rotatably in said circular opening of the collar and the headlamp unit being rotatable about said axis through a range of rotation, and at least one light-emitting element positioned between said first and second ends of the housing and arranged to project a beam of light in a direction perpendicular to said axis;

a set of circumferentially spaced notches formed on the ring-shaped protrusion adjacent the first end of the housing; and a resilient pawl fixed to the back part of the mounting bracket and engageable with said notches, and being in engagement with one of said notches for maintaining the headlamp unit in a fixed position within its range of rotation.

2. A personal headlamp according to claim 1, in which said collar is the sole means by which the headlamp unit is supported from the back part of the mounting bracket.

3. A personal headlamp according to claim 1, including a circumferential slot in said collar, and in which the resilient pawl extends from the front face of the back part of the mounting bracket, through said circumferential slot, into the circular opening of the collar.

4. A personal headlamp according to claim 3, in which the resilient pawl is a unitary part of the back part of the mounting bracket.

5. A personal headlamp according to claim 3, in which the collar is removably secured to the back part of the bracket.

6. A personal headlamp according to claim 3, in which the collar is removably secured to the back part of the bracket by screw fasteners extending through the back part of the bracket and threaded into the collar.

7. A personal headlamp according to claim 1, including an end cap connected to the ring-shaped protrusion at the first end of the housing, the end cap bearing against the collar and preventing the headlamp unit from disengaging from the collar.

8. A personal headlamp according to claim 7, in which at least two radially protecting tabs are formed on said ring-shaped protrusion, and in which the end cap is held on the ring shaped protrusion by said tabs.

9. A personal headlamp according to claim 8, in which the substantially circular opening of the collar has a plurality of axial slots formed therein positioned to provide clearance for said tabs on the ring-shaped protrusion when the ring-shaped protrusion is fitted into the opening of the collar in the assembly of the headlamp.

10. A personal headlamp according to claim 9, in which one of said notches on the ring-shaped protrusion extends to the first end of the housing, and the other notches terminate short of the first end of the housing, and in which said one of said notches is positioned to register with said pawl when the tabs formed on the ring-shaped protrusion register with the axial slots in the collar.

* * * * *